US008591204B2

(12) United States Patent
Yamaguchi

(10) Patent No.: US 8,591,204 B2
(45) Date of Patent: Nov. 26, 2013

(54) TURBO-MOLECULAR PUMP

(75) Inventor: Toshiki Yamaguchi, Nagaokakyou (JP)

(73) Assignee: Shimadzu Corporation, Kyoto-shi, Kyoto (JP)

( * ) Notice: Subject to any disclaimer, the term of this patent is extended or adjusted under 35 U.S.C. 154(b) by 376 days.

(21) Appl. No.: 12/934,800

(22) PCT Filed: Mar. 31, 2008

(86) PCT No.: PCT/JP2008/056350
§ 371 (c)(1),
(2), (4) Date: Sep. 27, 2010

(87) PCT Pub. No.: WO2009/122506
PCT Pub. Date: Oct. 8, 2009

(65) Prior Publication Data
US 2011/0014073 A1 Jan. 20, 2011

(51) Int. Cl.
*F04B 35/04* (2006.01)

(52) U.S. Cl.
USPC ..... 417/423.4

(58) Field of Classification Search
USPC ..... 417/423.4; 415/90
See application file for complete search history.

(56) References Cited

U.S. PATENT DOCUMENTS

| | | | | |
|---|---|---|---|---|
| 6,589,009 | B1 | 7/2003 | Shiokawa et al. | |
| 6,779,969 | B2 * | 8/2004 | Nonaka et al. | 415/90 |
| 6,926,493 | B1 * | 8/2005 | Miyamoto et al. | 415/90 |
| 2001/0016160 | A1 | 8/2001 | Ikegami et al. | |
| 2002/0028132 | A1 | 3/2002 | Ikegami et al. | |
| 2003/0017047 | A1 | 1/2003 | Shiokawa et al. | |

FOREIGN PATENT DOCUMENTS

| | | | |
|---|---|---|---|
| JP | 2001-082379 | A | 3/2001 |
| JP | 2003-262198 | A | 9/2003 |
| JP | 2006-170217 | A | 6/2006 |

OTHER PUBLICATIONS

International Search Report of PCT/JP2008/056350, mailing date Jun. 24, 2008.

* cited by examiner

*Primary Examiner* — Peter J Bertheaud
*Assistant Examiner* — Dnyanesh Kasture
(74) *Attorney, Agent, or Firm* — Westerman, Hattori, Daniels & Adrian, LLP

(57) ABSTRACT

A turbo-molecular pump includes a base 3; a rotor 4 rotatably supported thereon; a stator 400 disposed around the rotor 4; and a tubular casing 2 configured to accommodate the stator 400. The stator 400 includes multiple stages of stator blades 43 and spacers 48 alternately stacked one upon another on a flange surface 31 of the base 3. At least one of the spacers 48 is provided with a circular ring part 483 continuously formed thereof covering the outer circumferential surface of other spacers 48 inside the casing 2.

11 Claims, 4 Drawing Sheets

(a)

(b)

TURBO-MOLECULAR PUMP

TECHNICAL FIELD

The present invention relates to turbo-molecular pump.

BACKGROUND ART

There is known a turbo-molecular pump having a rotor that rotates at high speeds in a casing with a means that prevents energy generated by breakage of the rotor from being transmitted to the casing outside the rotor (cf., for example, Patent Reference 1). The one disclosed in Patent Reference 1 is provided with double inner casings inside the outer casing.

Patent Reference 1: Japanese Patent Laid-open Publication No. 2001-82379 (especially FIG. 2)

SUMMARY OF THE INVENTION

Problem to be Solved by the Invention

However, the one disclosed in Patent Reference 1 above has double inner casings, each of which is supported on the same flange surface, so that it is difficult to support both the inner casings without any unevenness.

Means for Solving the Problem

The turbo-molecular pump according to the present invention comprises: a base; a rotor rotatably supported on the base; a stator disposed around the rotor; and a cylindrical casing configured to accommodate the stator. The stator comprises multiple stages of stator blades and spacers alternately stacked one upon another on a flange surface of the base from a first stage to a last stage thereof, and at least one of the spacers is provided with a circular ring part continuously formed thereof that covers an outer circumferential surface of other spacers inside the casing.

A gap extending in a radial direction between the rotor and the stator may be smaller than a gap extending in the radial direction between the ring part and the casing.

The ring part may be provided so as to extend toward a side of the flange surface of the base.

In this case, it is preferred that the ring part is provided at the last stage spacer, with a distal end thereof extending to a side of the first stage spacer.

An outer circumferential stopper may be provided on the flange surface of the base inside the casing so as to cover an outer circumferential surface of the distal end of the ring part.

Advantageous Effect of the Invention

According to the present invention, spacers are provided with ring parts in linked relationship to cover an outer circumferential surface of other spacers, so that the stator and the ring parts can be supported between the base and the casing without any unevenness.

BEST MODE FOR CARRYING OUT THE INVENTION

-First Embodiment-

Hereafter, a first embodiment of the present invention will be described with reference to FIGS. 1 to 3.

Figure 1:
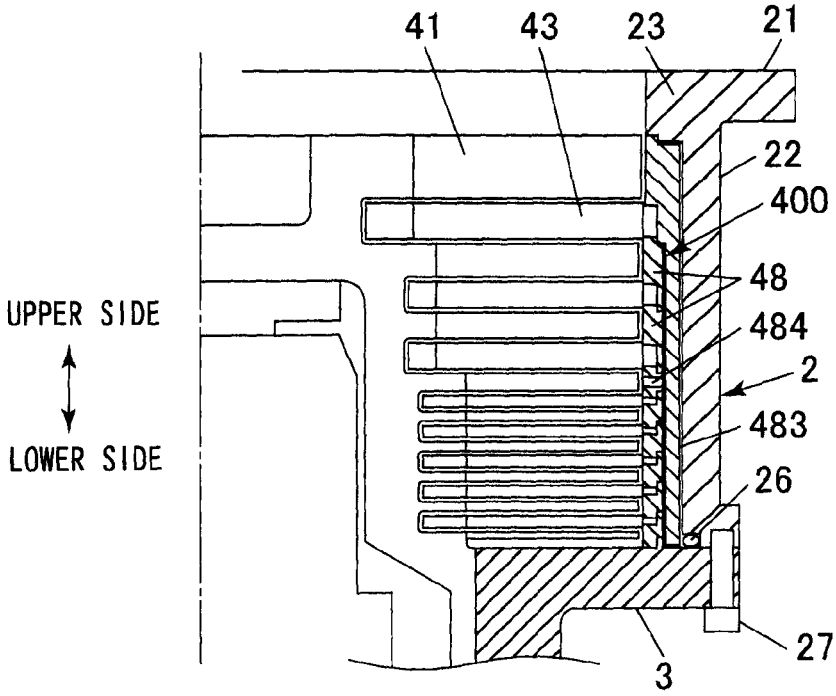
FIG. 1 A diagram showing the construction of a significant part of a turbo-molecular pump according to a first embodiment of the present invention.
Figure 1:
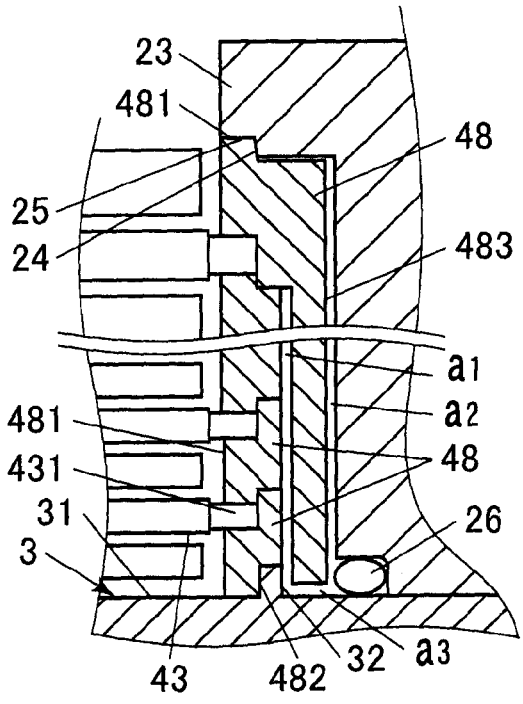

FIG. 1(*a*) presents a cross-sectional view showing the construction of a significant part of a turbo-molecular pump according to the first embodiment of the present invention. FIG. 1(*b*) presents an enlarged view of the chief part shown in FIG. 1(*a*). FIG. 2 presents a cross-sectional view schematically showing the construction of the whole turbo-molecular pump as the comparative example shown in FIG. 1. The turbo-molecular pump is, for example, a vacuum pump for use in a semiconductor manufacturing equipment. First, the schematic construction of the turbo-molecular pump is described referring to FIG. 2. For the sake of convenience, the vertical direction of the turbo-molecular pump herein is defined as shown in the drawings.

Figure 2:
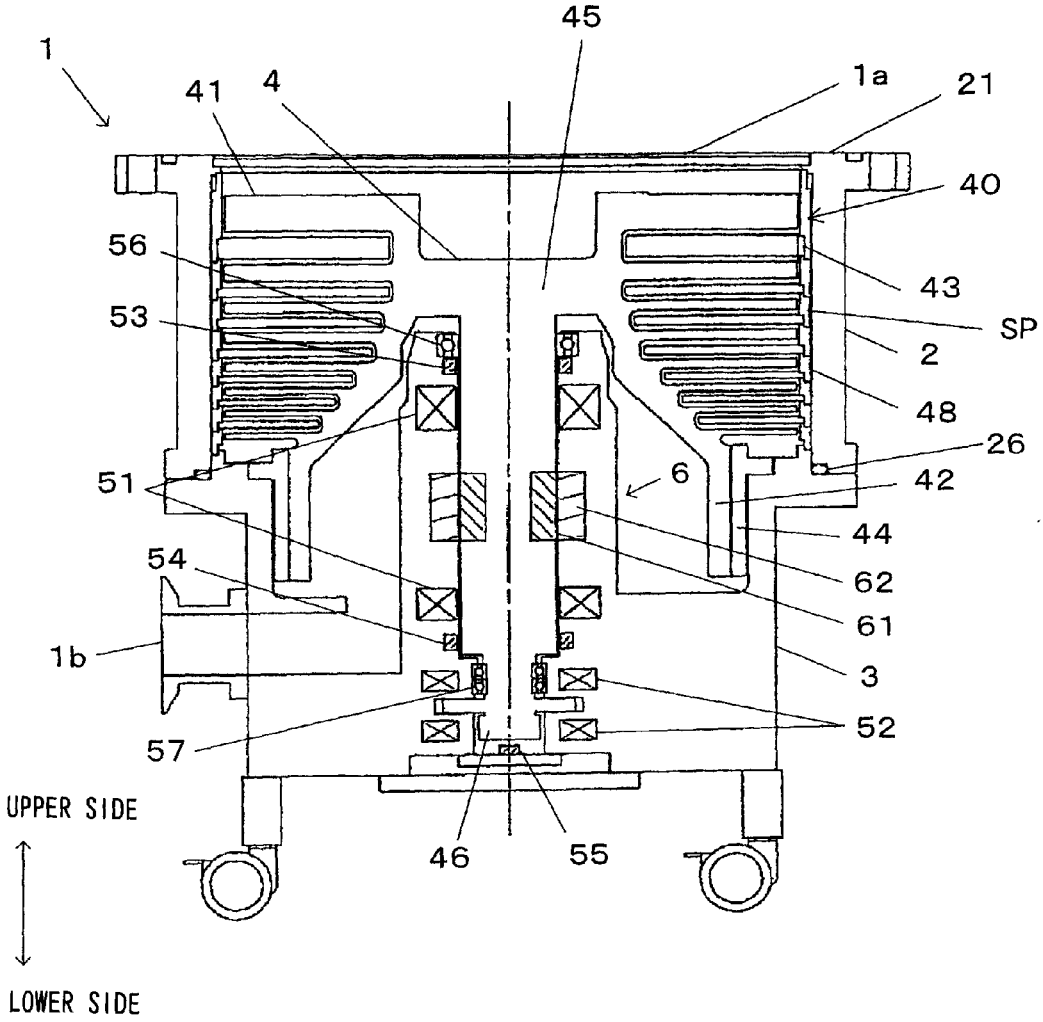
FIG. 2 A diagram schematically showing the construction of the whole turbo-molecular pump as a comparative example.
Figure 3:
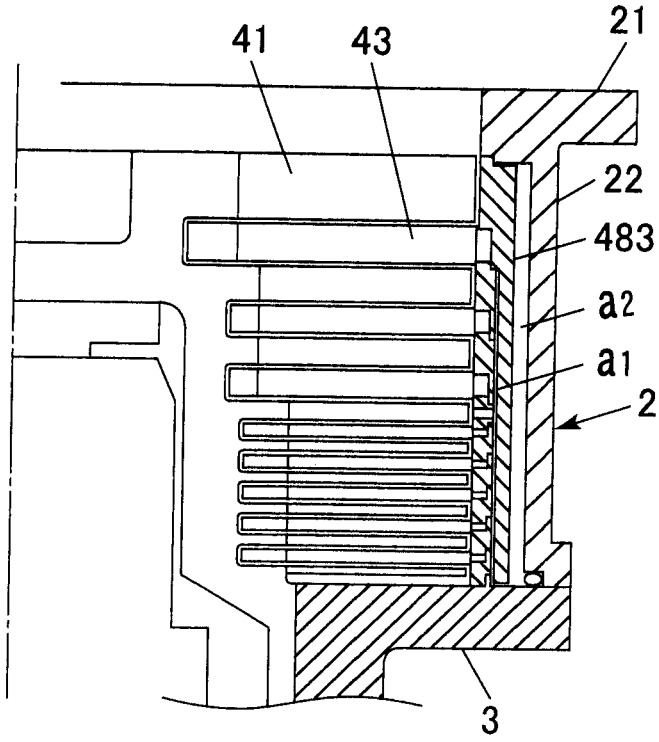
FIG. 3 A diagram showing a variation of the embodiment shown in FIG. 1.

As shown in FIG. 2, a pump body 1 of the turbo-molecular pump includes an outer casing 2, which is substantially cylindrical, a base 3 provided below the outer casing 2, and a rotor 4 accommodated in the outer casing 2 and rotatably supported on the base 3. An upper flange 21 above the outer casing 2 is fixed with bolts to a flange (not shown) of a vacuum chamber on the side of the semiconductor manufacturing equipment. A lower surface of the outer casing 2 and an upper surface of the base 3 are fastened to each other with bolts 27 (FIG. 1) through an O-ring 26.

A plurality of stages of rotor blades 41 are provided on an outer circumferential surface of the rotor 4 at intervals in the vertical direction. A stator blade 43 is inserted between any two adjacent rotor blades 41 such that the rotor blade 41 and the stator blade 43 are alternately disposed. A plurality of stages of the stator blades 43 are stacked with spacers 48. A rotary cylindrical part 42 is provided beneath the rotor blades 41 of the rotor 4. A stationary cylindrical part 44 is provided on the side of the base 3, facing the rotary cylindrical part 42. A spiral groove is formed on an inner circumferential surface of the stationary cylindrical part 44. The rotor blades 41 and stator blades 43 mentioned above constitute a turbine blade part and the rotary cylindrical part 42 and the stationary cylindrical part 44 constitute a molecular drag pump part.

The rotor 4 is supported in a contactless manner by a pair of vertically arranged radial magnetic bearings 51 and a pair of vertically arranged axial magnetic bearings 52 and is driven for rotation by a motor 6. The motor 6 is, for example, a DC brushless motor, which includes a motor rotor 61 having built therein a permanent magnet attached to a shaft part 45 of the rotor 4 and a motor stator 62 provided on the side of the base 3 for forming a rotating magnetic field.

The magnetic bearings 51, 52 are provided with radial displacement sensors 53, 54 and a thrust displacement sensor 55 for detecting an uplift position of the rotor 4. A sensor target 46 is provided on a lower end of the shaft part 45 and the gap sensor 55 is provided opposite to the sensor target 46. Note that 56 and 57 designated mechanical bearings for emergency use.

In the turbo-molecular pump 1 having the above-mentioned construction, gas molecules flow in through an inlet 1*a* due to high speed rotation of the rotor 4. The flown-in gas molecules are pumped out through an outlet 1*b* via the turbine blade part and the molecular drag pump part. This flow of the gas molecules results in a high vacuum state on the side of the inlet 1*a*.

Here, if the rotor 4 is broken from any cause during its high speed rotation, the broken rotor 4 flies apart around due to centrifugal force, and a rotation torque through to the flying material acts on the outer casing 2 in the same direction as the rotation direction of the rotor 4. The rotation torque acts on the flange of the vacuum system via the upper flange 21, so that there is the possibility that the vacuum system equipment is damaged. To prevent this, according to the present embodiment, a substantially ring-shaped casing part is provided on the inner side of the outer casing 2 in the manner as described below.

As shown in FIG. 1, a protruding part 23 that protrudes in the inner side of a circumferential wall 22. A recessed portion 24 is formed along a circumferential direction on the lower surface of the protrusion part 23 and formation of the recessed portion 24, providing a flange surface 25. On the other hand, a flange surface 31 is formed on the upper surface of the base 3. A protruding part 32 is provided on the flange surface 31 along the circumferential direction.

The spacers 48 are each substantially ring-shaped and the stator blades 43 have respectively a half-split shape being divided into two halves along the circumferential direction. The rotor 4 and stator blades 43 are made of aluminum alloy. The spacers 48 and the outer casing 2 are made of a material having higher strength than the aluminum alloy, for example, stainless steel.

Stepped portions 481, 482 are provided on its upper and lower surfaces, respectively, of each spacer 48 along the circumferential direction and a flange part 431 is provided on an outer circumferential edge of each stator blade 43 in the circumferential direction. The spacer 48 having a predetermined thickness and the flange part 431 of the stator blade 43 are alternately stacked to constitute as a whole a stacked body 400 (stator). The stacked body 400 is sandwiched between the flange surface 31 of the base 3 and the flange surface 25 of the outer casing 2 by the fastening force of the bolts 27.

The lower stepped portion 482 of the lowest spacer 48 is fitted with the protruding part 32 of the base 3 and the spacer 48 is positioned relative to the base 3. The flange part 431 of the stator blade 43 is fitted with the upper stepped portion 481 of the spacer 48 and the stator blade 43 is positioned through the spacer 48. The recessed portion 24 of the outer casing 2 is fitted with the stepped portion 481 of the uppermost spacer 48, and the outer casing 2 is positioned through the spacer 48.

The uppermost spacer 48 is integrally provided with a cylindrical casing part 483. The casing part 483 has a larger diameter than other spacers 48 and extended downward over the flange surface 31 of the base 3, and the entire outer circumference of the stack 400 is covered by the casing part 483.

The gaps a1 to a3 are provided between the casing part 483 and the stacked body 400 inside thereof, between the casing par 483 and the outer casing 2 outside thereof, and between the casing part 483 and the base 3 on the top thereof, respectively. With this construction, interference between the casing part 483 and surrounding components upon attaching the spacers 48 can be prevented. It is to be noted that the gap a3 between the casing part 483 and the flange surface 31 of the base 3 is set such that the gap a3 is smaller in height than at least the lowermost spacer 48; for example, the lower end surface of the casing part 483 extends below the upper surface of the protruding part 32.

The spacer 48 arranged in the central part of the stack 400 in the height direction is formed of a through-hole 484 extending in the radial direction. The through-hole 484 is designed for pumping out the staying gas in the gaps a1 to a3 to a gas passage inside the stacked body 400. The gas passage on the downstream side and the gaps a1 to a3 are communicated with each other through the through-hole 484.

When the pump body 1 of the pump is to be assembled, first the rotor 4 is rotatably supported on the base 3, and the lowermost spacer 48 is set on the flange surface 31 of the base 3. Subsequently, the stator blade 43 and the spacer 48 are alternately stacked while the steps 481, 482 and the flange parts 341 are fitted with each other. When the stacking of the uppermost spacer 48 is completed, outer circumferences of the stator blades 43 and the spacers 48 are covered by the flange part 483. Further, the outer casing 2 is placed over the stacked body 400 to cover it and the lower end surface of the outer casing 2 is fastened to the flange surface 31 of the base 3 with the bolts 27. As a result, the stacked body 400 consisting of the spacers 48 and the stator blades 43 is sandwiched between the flange surface 31 of the base 3 and the flange surface 25 of the outer casing 2.

Main operations of the turbo-molecular pump according to the first embodiment are described below.

If the rotor 4 is broken from any cause during its high speed rotation, the flying materials formed as a result of the breakage collide with the inner wall surface of the casing 431 via the stator blades 43 and the spacers 48. This causes the casing part 431 to be deformed or rotated relatively with respect to the outer casing 2 due to the torque given by the flying materials from the rotor 4, so that the energy of the breakage of the rotor is absorbed by the casing part 431. This function of the casing part 431 can prevent the rotation torque generated by the breakage of the rotor 4 from being transmitted to the outer casing 2, so that the vacuum system equipment can be prevented from being damaged.

According to the above-mentioned embodiment, the following advantageous effects can be obtained.

(1) A casing part 483 having a large diameter is continuously formed in the uppermost spacer 48 so that the outer circumferences of the stator blades 43 and the spacers 48 are covered by the casing part 483. This can prevent shock of the breakage of the rotor 4 from being transmitted to the outer casing 2 and allow the casing part 483 to be supported without any unevenness. If the casing part 483 is provided separately from the spacer 48 and supported on the flange surface 31 of the base 3, unevenness at the placing position where the casing part 483 is attached tends to occur, since the spacer 48 and the casing part 483 are supported between the base 3 and the outer casing 2 separately from each other. On the contrary, according to the present embodiment, the casing part 483 is integrally provided with the spacer 48, so that it is unnecessary to support the casing part 483 separately, so that the unevenness of placing the casing part 483 can be prevented from occurring.

(2) Since the casing part 483 and the spacer 48 are provided integrally with each other, an increase in the number of components can be prevented, so that the cost can be reduced and the pump body 1 can be assembled with ease.

(3) Since the cylindrical casing part 483 is arranged outside the stacked body 400, the strength of the casing in whole can be maintained even if the thickness of the circumferential wall 22 of the outer casing 2 is correspondingly reduced on the side of the inner diameter. As a result, the outer diameter of the outer casing 2 does not have to be increased, so that the pump body 1 can be prevented from growing in size.

(4) Since the casing part 483 extends downward, the spacers 48 can be stacked with ease.

(5) Since the casing part 483 is provided so as to extend from the uppermost spacer 48 to the base 3 such that the stacked body 400 in whole is covered by the casing 48, the energy of the breakage of the rotor can be assuredly absorbed by the casing part 48.

(6) The spacer 48 is provided with the through-holes 484 along the radial direction the gas which remains in the gaps a1 to a3 can be flown toward the downstream side of the gas passage, so that the inlet 1*a* side can be maintained in a high vacuum state.

(7) Since the gaps a1 to a3 are provided around the casing part 483, the casing part 483 does not interfere with other components, so that the pump body 1 can be assembled with ease.

In the above-mentioned embodiment, the gaps a1 and a2 are provided on the inside and outside sides, respectively, in the radial direction of the casing part 483. In this case, the outer gap a2 may be larger than the inner gap a1 as shown in FIG. 3. With this construction, the casing part 483 can be deformed to a greater extent outward in the radial direction inside the outer casing 2 when the flying materials formed upon the breakage of the rotor collide therewith, so that the energy of the breakage of the rotor can be absorbed efficiently.

-Second Embodiment-

A second embodiment of the present invention will be described with reference to FIG. 4.

Figure 4:
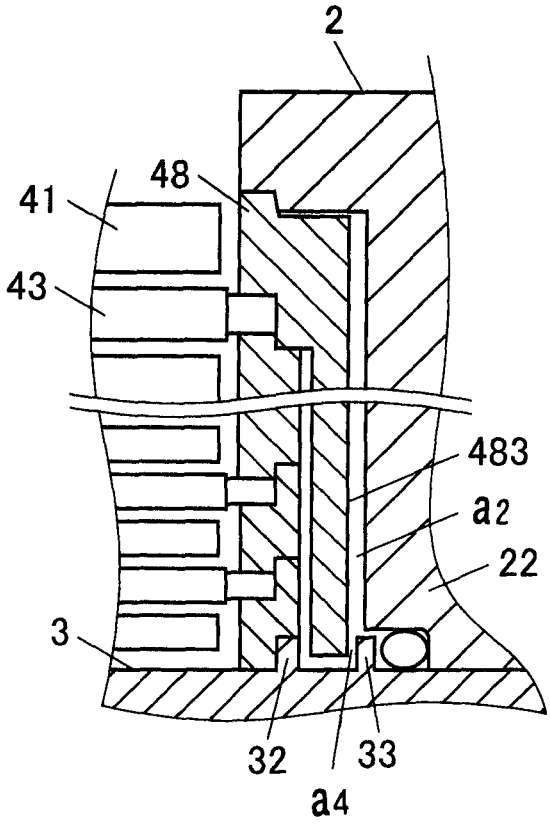
FIG. 4 A diagram showing the construction of a significant part of a turbo-molecular pump according to a second embodiment of the present invention.

FIG. 4 presents a cross-sectional view showing the construction of a significant part of a turbo-molecular pump according to a second embodiment. The same portions as those shown in FIG. 2(*b*) are given the same reference numerals and the following description is focused on differences from the first embodiment.

The second embodiment differs from the first embodiment in the form of the flange surface 31 of the base 3. More particularly, the flange surface 31 has further provided thereon a protruding portion 33 outside the protruding portion 32 in the radial direction along the entire circumference thereof. An upper end surface of the protruding portion 33 is positioned higher than a lower end surface of the casing part 483 and a gap a4 is provided in the radial direction between the casing part 483 and the protruding portion 33. The gap a4 is formed so as to be smaller than the gap a2 between the casing part 483 and the protrusion 33.

With this construction, when the rotor 4 is broken to deform the casing part 483 outward, the casing part 483 comes in contact with the protruding portion 33 before it comes in contact with the circumferential wall 22 of the outer casing 2. Therefore, the deformation of the casing part 483 is prevented by the protrusion 33, so that the contact of the casing part 483 with the outer casing 2 can be prevented.

In the above-mentioned embodiment, the spacers 48 are made of stainless steel. However, it may also be constructed such that only the uppermost spacer 48 having the casing part 483 is made of stainless steel and other spacers 48 are made of aluminum or the like similarly to the stator blades 43. Although the spacers 48 and the stator blades are stacked through the stepped portions 481, 482, the construction of the stack 400 as the stator is not limited thereto. For example, a pin may be protruded on an upper surface of each spacer 48 and the spacers 48 and the stator blades may be stacked while positioning through the pins.

The construction of the base 3 that rotatably supports the rotor 4 and the construction of the outer casing 2 as a casing configured to accommodate the stacked body 400 are not limited to those described above. Although the casing part 483 is provided at the uppermost (last stage) spacer 48, the construction of the ring part is not limited thereto so far as the ring part is formed in an annular form such that it covers at least outer circumference surface of other spacers 48. The casing part 483 may be provided at spacers 48 other than the uppermost one or the casing part 483 may be provided at a plurality of spacers 48.

Although the casing part 483 is provided so as to extend to the side of the lowermost (first stage) spacer 48, the position of the distal end of the casing part 483 may be set higher than that. The casing part 483 may be provided upward instead of downward of the stacked body 400. Although the protruding portion 33 is provided so that it covers the outer circumferential surface of the distal end of the ring portion 483 (FIG. 4), the form of the outer circumference stopper is not limited thereto. That is, the present invention is not limited to the turbo-molecular pumps according to the embodiments so far as the features and functions of the present can be realized.

The invention claimed is:

1. A turbo-molecular pump, comprising:

a base;

a rotor rotatably supported on the base;

a stator disposed around the rotor; and a cylindrical outer casing configured to accommodate the stator, having a flange surface of the outer casing; wherein the stator comprises multiple stages of stator blades and spacers alternately stacked one upon another in an axial direction from a first stage of the stator to a last stage of the stator, the spacers being held between a flange surface of the base and the flange surface of the outer casing, and at least one of the spacers is integrately provided with a casing part that covers an outermost circumferential surface of at least one of other spacers inside the outer casing, the one the spacers and the casing part being formed as a monolithic piece;

wherein the at least one of the spacers makes contact with the flange surface of the outer casing, and has a plane of contact with a first stage stator blade; and all portions of the at least one spacers between the flange surface of the outer casing and the plane of contact are homogeneous.

2. The turbo-molecular pump according to claim 1, wherein a gap in a radial direction between the outermost circumferential surface of the spacers covered by the casing part and the casing part is smaller than a gap in the radial direction between the casing part and the outer casing.

3. The turbo-molecular pump according to claim 1, wherein the casing part extends in the axial direction toward a side of the flange surface of the base.

4. The turbo-molecular pump according to claim 3, wherein the casing part is provided at a spacer of the last stage of the stator, with a distal end thereof extending in the axial direction to a side of a spacer of the first stage of the stator.

5. The turbo-molecular pump according to claim 4, wherein an outer circumferential stopper is provided on the flange surface of the base inside the outer casing so as to cover an outer circumferential surface of the distal end of the casing part.

6. The turbo-molecular pump according to claim 4, wherein a predetermined size of gap is provided between a distal end of the casing part and the flange surface of the base, through which a gap between the outermost circumferential surface of the spacers covered by the casing part and the casing part in the radial direction and a gap between the casing part and the outer casing in the radial direction are communicated.

7. The turbo-molecular pump according to claim 1, wherein a predetermined size of gap is provided between a distal end of the casing part and the flange surface of the base, through which a gap between the outermost circumferential surface of the spacers covered by the casing part and the casing part in the radial direction and a gap between the casing part and the outer casing in the radial direction are communicated.

8. The turbo-molecular pump according to claim 2, wherein the casing part extends in the axial direction toward a side of the flange surface of the base.

9. The turbo-molecular pump according to claim 8, wherein the casing part is provided at a spacer of the last stage of the stator, with a distal end thereof extending in the axial direction to a side of a spacer of the first stage of the stator.

10. The turbo-molecular pump according to claim 9, wherein an outer circumferential stopper is provided on the flange surface of the base inside the outer casing so as to cover an outer circumferential surface of the distal end of the casing part.

11. The turbo-molecular pump according to claim 9, wherein a predetermined size of gap is provided between a distal end of the casing part and the flange surface of the base, through which a gap between the outer circumferential surface of the spacers covered by the casing part and the casing part in the radial direction and a gap between the casing part and the outer casing in the radial direction are communicated.

* * * * *